United States Patent [19]

Grilliot et al.

[11] Patent Number: 4,748,691

[45] Date of Patent: Jun. 7, 1988

[54] FIREFIGHTER'S COAT WITH STABILIZED WATERPROOF COLLAR

[76] Inventors: William L. Grilliot; Mary I. Grilliot, both of 1986 Home Ave., Dayton, Ohio 45417

[21] Appl. No.: 84,198

[22] Filed: Aug. 12, 1987

[51] Int. Cl.[4] ..... A41D 1/02; A41D 13/00

[52] U.S. Cl. ..... 2/81; 2/82; 2/87; 2/93; 2/272

[58] Field of Search ..... 2/81, 82, 87, 93, 97, 2/272, 243 R

[56] References Cited

U.S. PATENT DOCUMENTS 2,709,667 5/1955 Grubb et al. .
3,686,064 8/1972 Bonnet et al. ..... 2/82 X
4,034,417 7/1977 Ellis .
4,502,153 3/1985 Lapedes et al. .
4,507,806 4/1985 Coombs .
4,583,247 4/1986 Fingerhut et al. ..... 2/81 X
4,604,759 8/1986 Bowman et al. .
4,627,112 12/1986 Grilliot et al. ..... 2/93 X

*Primary Examiner*—H. Hampton Hunter
*Attorney, Agent, or Firm*—Jacox & Meckstroth

[57] ABSTRACT

A firefighter's coat has a body section and a collar section, each of these sections has an outer layer and an inner layer and an intermediate moisture barrier layer. The intermediate moisture barrier layer is waterproof to prevent moisture flow therethrough, and the intermediate moisture barrier layer is also attached to at least one of the other layers to provide stability among the layers.

27 Claims, 2 Drawing Sheets

FIREFIGHTER'S COAT WITH STABILIZED WATERPROOF COLLAR

BACKGROUND OF THE INVENTION

A firefighter's coat normally includes a body portion and a collar portion. The body portion and the collar portion are constructed of an outer shell layer which is flame resistant and an intermediate liner which is a moisture barrier layer and an inner layer liner which is a thermal barrier. These layers may be three separate distinct layers or one or two members.

In one type of construction in the past, the intermediate or moisture barrier of the collar portion is attached to the shell and to the inner liner by means of stitching at the neck line. Such stitching extends through all three layers, from the outside to the inside. This construction completely encloses the intermediate moisture barrier and prevents any sealing of holes caused by stitching. This is an objectionable construction in that water may seep through the stitched portions and engage the wearer of the coat.

In another known type of construction, such as shown in U.S. Pat. No. 4,604,759, in an attempt to provide a waterproof collar, the intermediate liner or moisture barrier, is "free floating" and is not attached to the shell or to the inner liner at the collar portion. Thus, there is no stitched portion through which water may seep. However, such a collar portion is not stabilized. The free floating moisture barrier frequently presents problems, such as bulging at the collar and difficulty sometimes occurs in donning the coat.

SUMMARY OF THE INVENTION

It is an object of this invention to provide a firefighter's coat in which the collar portion, as well as all other portions of the coat, is waterproof and in which all layers of the collar portion are stabilized so that no bulging of the collar portion occurs and problems in donning the coat are minimal.

A firefighter's coat of this invention comprises a body portion and a collar portion. Extending through both of these portions are an outer shell, an intermediate liner or moisture barrier, and an inner thermal barrier. These three layers are attached together at the upper edge of the collar portion. Furthermore, within the collar portion, the intermediate liner or moisture barrier is attached to the outer shell and/or to the inner liner in a manner which maintains a waterproof collar portion and in which the collar portion is stabilized. Thus, the collar portion is waterproof but does not present bulging or donning problems.

Other objects and advantages of this invention reside in the construction of parts, the combination thereof, the method of production and the mode of use, as will become more apparent from the following description.

DETAILED DESCRIPTION OF THE PREFERRED EMBODIMENT

Figure 1:
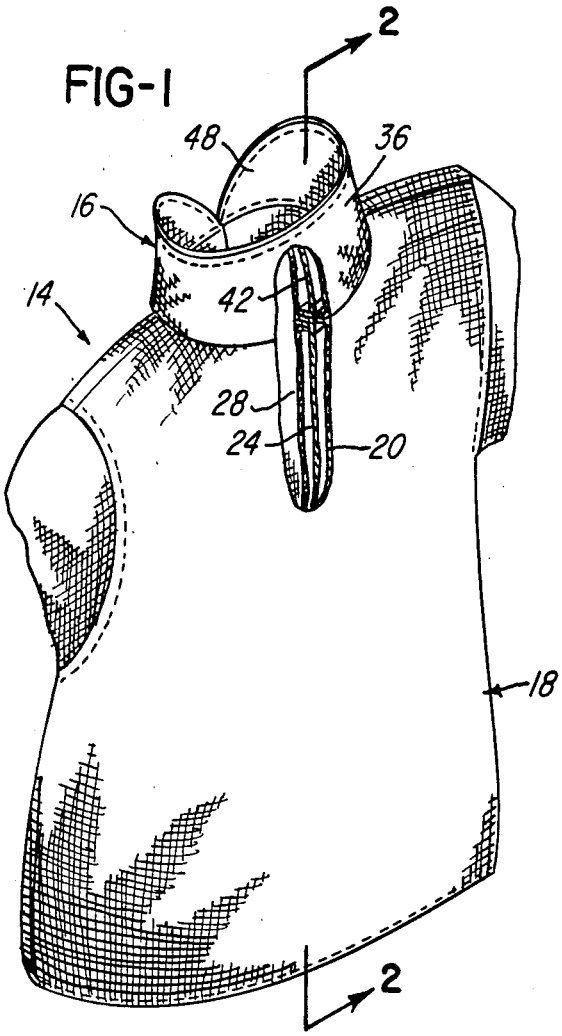
FIG. 1 is a back perspective view of a firefighter's coat of this invention, with parts broken away and shown in section.
Figure 2:
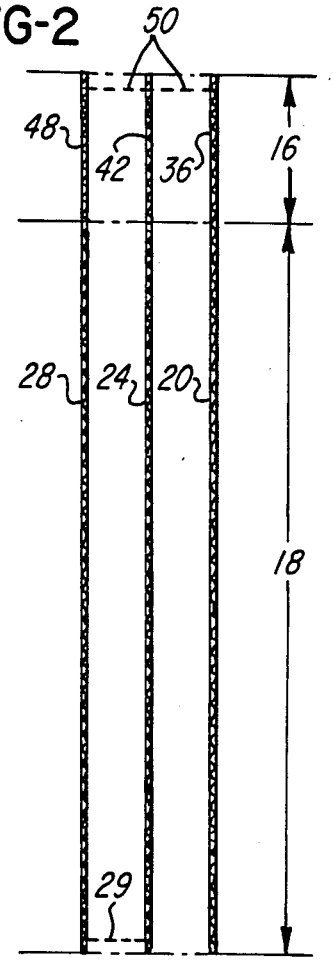
FIG. 2 is an enlarged sectional diagrammatic view taken substantially on line 2—2 of FIG. 1.

FIG. 1 shows a firefighter's coat 14 which includes a collar portion 16. As illustrated in FIG. 2, the firefighter's coat 14 comprises a body portion 18 which includes an outer layer or shell 20, an intermediate layer or moisture barrier 24, and an inner layer or thermal barrier 28. As illustrated in FIG. 2, the layers 24 and 28 are attached together at the lower parts thereof, by any suitable means 29.

Figure 3:
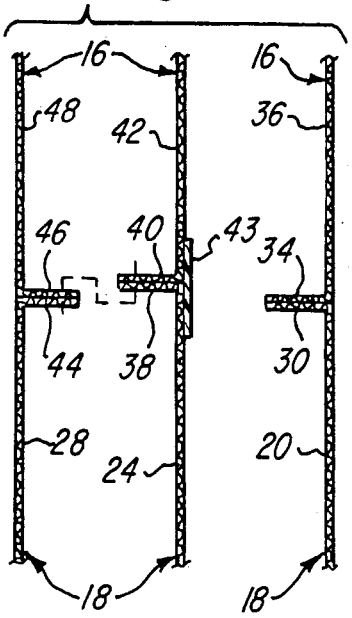
FIG. 3 is an enlarged fragmentary diagrammatic exploded sectional view illustrating an embodiment of this invention.
Figure 6:
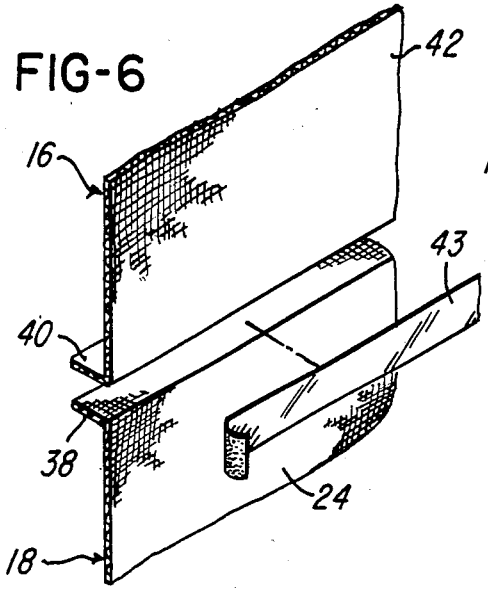
FIG. 6 is a fragmentary perspective exploded view illustrating an intermediate liner or moisture barrier constructed in accordance with the embodiment of FIG. 3.
Figure 7:
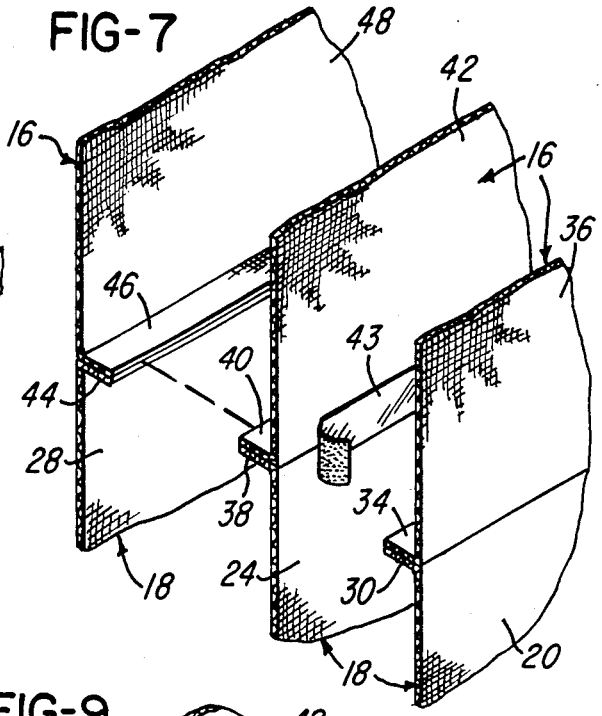
FIG. 7 is a fragmentary perspective exploded view illustrating the embodiment of FIG. 3.

FIGS. 3, 6, and 7 illustrate an embodiment of this invention in which the outer layer 20 of the body portion 18 has a tab 30 at the upper portion thereof and which extends angularly from the outer layer 20. The tab 30 is preferably an integral part of the layer 20. Attached to the tab 30 is a tab 34 which is a part of an outer layer 36 of the collar portion 16. The tabs 30 and 34 are attached together by any suitable means, such as by stitching or by adhesive means or by any other suitable means. The outer layer 36 of the collar portion is of the same material as the outer layer 20 of the body 18 and forms an extension thereof.

The intermediate layer 24 of the body 18 has a tab 38 at the upper portion thereof. The tab 38 is preferably integral with the layer 24, but may be a separate element attached to the layer 24. The tab 38 may have any suitable length along the width of the layer 24. The tab 38 is attached by any suitable means to a tab 40 which is a part of an intermediate layer 42 of the collar portion 16. The collar intermediate layer 42 extends upwardly from the body intermediate layer 24. The collar intermediate layer 42 is preferably of the same material as the body intermediate layer 24 and forms an extension thereof as a moisture barrier. An elongate strip 43 of waterproof material is attached to the body intermediate layer 24 and to the collar intermediate layer 42, to seal the joint therebetween. Preferably, but not necessarily, the strip 43 is adhesively attached to the body intermediate layer 24 and to the collar intermediate layer 42.

The body inner layer 28 has a tab 44 at the upper portion thereof. Attached to the tab 44, is a tab 46 which is a part of a collar inner layer 48. The collar inner layer 48 is preferably of the same material as the body inner layer 28 and serves as an extension thereof. As illustrated in FIG. 2 the upper portions of the collar layers 36, 42, and 48 are attached together by any suitable connection means 50.

As illustrated, the tabs 38 and 40 of the intermediate layers 24 and 42 are attached to the tabs 44 and 46 of the inner layers 28 and 48. Thus, the body and collar intermediate layers or moisture barriers 24 and 42 are attached to the body and collar inner layers 28 and 48. Thus, the body moisture barrier 24 and the collar moisture barrier 42 are attached to the inner body layer 28 and to the inner collar layer 48, and the moisture barrier members 24 and 42 are sealed against moisture flow therethrough. Thus, the entire coat 14, including the collar portion 16, is waterproof, and the moisture barrier members 24 and 42 are secured between the inner layer members 28 and 48 and the outer layers 20 and 36. Thus, the collar portion 16 maintains stability at all times and no bulging occurs within the collar portion 16.

Figure 4:
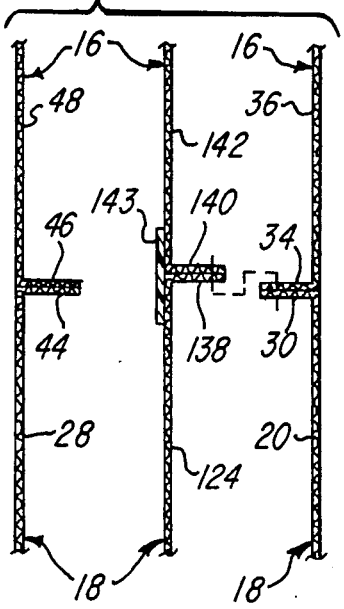
FIG. 4 is an enlarged fragmentary diagrammatic exploded sectional view illustrating another embodiment of this invention.
Figure 10:
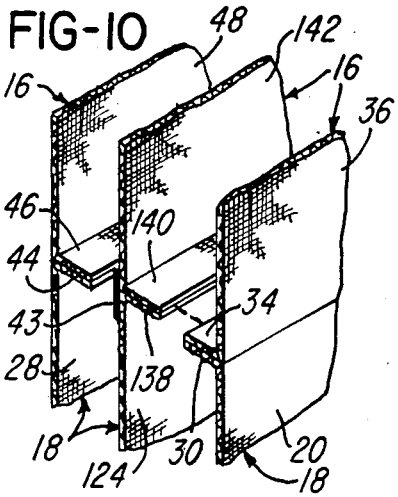
FIG. 10 is an exploded fragmentary perspective view illustrating the embodiment of FIG. 4.

FIGS. 4 and 10 illustrate another embodiment of this invention in which an intermediate body layer or moisture barrier 124 has a tab 138. The tab 138 is attached by any suitable means to a tab 140 of an intermediate collar layer or moisture barrier 142. An elongate strip 143, which may be similar to the strip 43, is attached to the intermediate collar layer 142 and to the intermediate body layer 124 and seals the joint therebetween.

The tabs 140 and 138 are attached by any suitable means to the tabs 34 and 30 of the body outer layer 20 and the collar outer layer 36, as shown in FIGS. 4 and 10.

Figure 5:
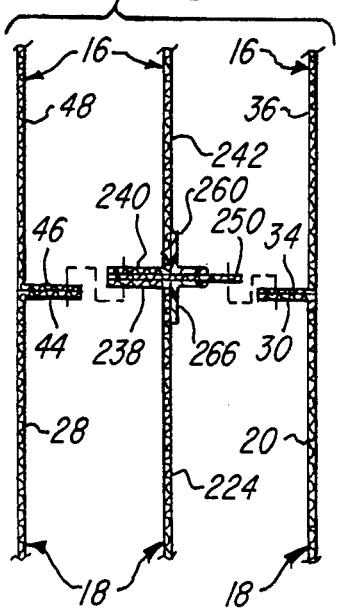
FIG. 5 is an enlarged fragmentary diagrammatic exploded sectional view illustrating another embodiment of this invention.
Figure 8:
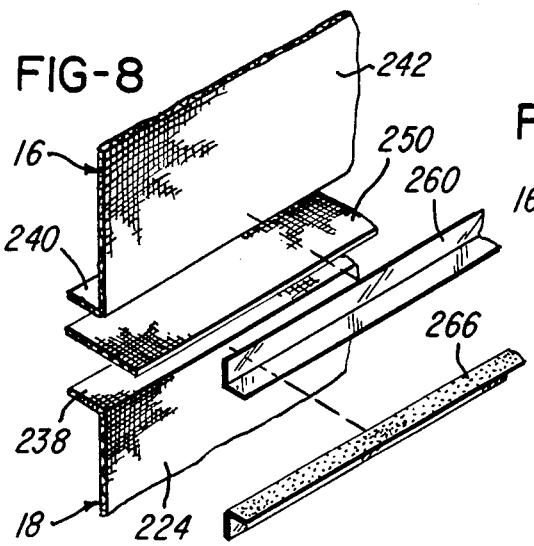
FIG. 8 is a fragmentary perspective exploded view illustrating the construction of an intermediate liner or moisture barrier in accordance with the embodiment of FIG. 5.
Figure 9:
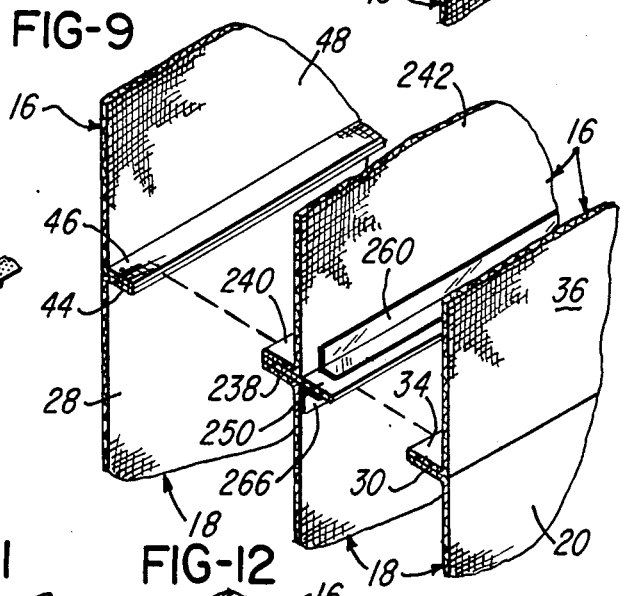
FIG. 9 is a fragmentary perspective exploded view illustrating the embodiment of FIG. 5.

FIGS. 5, 8, and 9 illustrate another embodiment of this invention in which an intermediate body layer 224 has a tab 238. Above the intermediate body layer 224 is an intermediate collar layer 242, which has a tab 240. Positioned between the tabs 238 and 240 is an elongate connection element 250. The connection element 250 is also positioned between the body intermediate layer member 224 and the collar intermediate layer 242 and extends therefrom. Above the connection element 250 is an angular strip 260 which engages the connection element 250 and the collar intermediate layer 242 and is attached thereto. Thus, the angular strip 260 seals between the connection element 250 and the collar intermediate layer 242.

Below the connection element 250 and attached thereto is an angular strip 266 which is also attached to the body intermediate layer 224. Thus, the angular strip 266 seals between the body intermediate layer 224 and the connection element 250. The connection element 250 extends from the angular strips 260 and 266 and is attached by any suitable means to the tabs 30 and 34 of the outer body layer 20 and the outer collar layer 36, as illustrated in FIGS. 5 and 9. Also, as shown in FIGS. 5 and 9, the tabs 238 and 240 and the connection element 250 are attached to the tabs 44 and 46. Thus, the body intermediate layer 224 and the collar intermediate layer 242 are attached to the body and collar outer layers 20 and 36 and to the body and collar inner layers 28 and 48.

Figure 11:
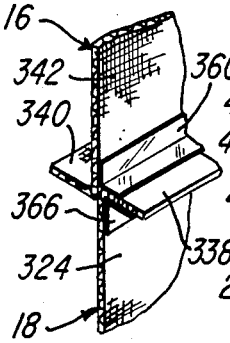
FIG. 11 is a fragmentary perspective view illustrating another embodiment of a moisture barrier constructed in accordance with this invention.

FIG. 11 illustrates another embodiment of this invention in which a body intermediate layer 324 has a tab 338 which extends to the right. Above the body intermediate layer 324 is a collar intermediate layer 342 which has a tab 340 which extends to the left. Attached to the tab 338 and to the collar intermediate layer 342 is an angular strip 360. Attached to the tab 338 and to the body intermediate layer 324 is an angular strip 366. Thus, the body intermediate layer 324 is attached to the collar intermediate layer 342, and the joint therebetween is sealed. Then the tab 340 may be attached to the tabs 44 and 46, to attach the body intermediate layer 324 and the collar intermediate layer 342 to the body inner layer 28 and to the collar inner layer 48. As an alternative, the tab 338 may be attached to the tabs 30 and 34 to attach the body intermediate layer 324 and the collar intermediate layer 342 to the body outer layer 20 and the collar outer layer 36. Also, of course, the tab 338 may be attached to the tabs 30 and 34, and the tab 340 may be attached to the tabs 44 and 46 to secure the body intermediate layer 324 and the collar intermediate layer 342 to both the body inner layer 28 and the collar inner layer 48 and also to the body outer layer 20 and to the collar outer layer 36.

Figure 12:
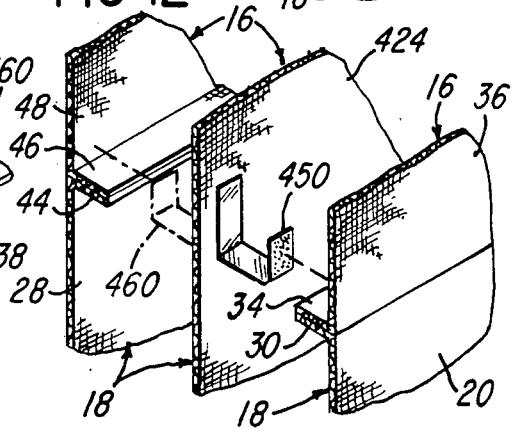
FIG. 12 is a fragmentary exploded perspective view illustrating another embodiment of this invention.

FIG. 12 illustrates another embodiment of this invention. An intermediate layer or moisture barrier layer 424 is a continuous layer through both the body portion 18 and the collar portion 16. Thus, the intermediate or moisture barrier layer 424 is waterproof. A tab 450 is attached to the moisture barrier layer 424 and to one of the tabs 34 or 30 of the outer collar layer 36 and the outer body layer 20. The tab 450 may be attached only to the outer collar layer 36. Thus, the moisture barrier layer 424 is attached to the outer collar layer 36 and to the outer body layer 20. Also, if desired, a tab 460 may be attached to the intermediate layer 424 and to the tab 46 and/or to the inner collar layer 48. Furthermore, Thus, the moisture barrier layer 424 may be attached to either the outer layer members 20 and 36 and/or to the inner layer members 28 and 48. Thus, a waterproof intermediate moisture barrier layer is maintained while stability of the collar portion 16 is also maintained.

SUMMARY

Thus, it is understood that this invention provides structure and methods by which an intermediate layer or moisture barrier layer is completely waterproof, while also providing structure and methods by which a moisture barrier layer is attached to either an inner layer or to an outer layer, or to both. The attachment is preferably, but not necessarily, in a collar portion or in a position adjacent the collar portion. Thus, the possibility of bulging or wrinkling in the collar portion is eliminated, and, in the same structure, the moisture barrier layer is sealed against water flow therethrough. Thus, this invention solves the problem of providing a waterproof moisture barrier layer, while also providing a stabilized collar portion in a firefighter's coat.

Although the preferred embodiment of the firefighter's coat of this invention has been described, it will be understood that within the purview of this invention various changes may be made in the form, details, proportion and arrangement of parts, the combination thereof, and the methods of construction, which generally stated consist in a structure and/or method within the scope of the appended claims.

The invention having thus been described, the following is claimed:

1. A firefighter's coat which is waterproof while also having a stabilized collar section, the coat comprising a body section and a collar section, the body section including an outer layer and an intermediate moisture barrier layer and an inner layer, the collar section including an outer layer and an intermediate moisture barrier layer and an inner layer, the collar section having an attachment portion adjacent the body section, moisture barrrier means joining the intermediate moisture barrier layer of the collar section to the intermediate moisture barrier layer of the body section, connection means attaching the intermediate moisture barrier layer of the body section and the intermediate moisture barrier layer of the collar section to at least one of the other layers at a position adjacent the attachment portion of the collar section, the intermediate moisture barrier layer of the collar section and the intermediate moisture barrier layer of the body section and the moisture barrier means thus preventing flow of water therethrough while being attached to at least one of the other layers to provide a stabilized collar section.

2. The firefighter's coat of claim 1 in which the connection means includes means attaching the intermediate layer of the body section and the intermediate layer of the collar section to the outer layer.

3. The firefighter's coat of claim 1 in which the connection means includes means attaching together the intermediate layer of the body section and the intermediate layer of the collar section.

4. The firefighter's coat of claim 1 in which the intermediate layer of the collar section includes a tab and in which the intermediate layer of the body section includes a tab, attachment means attaching the tab of the intermediate layer of the collar section to the tab of the intermediate layer of the body section, and attachment means attaching the tabs to at least one of the other layers.

5. The firefighter's coat of claim 1 in which the connection means includes means attaching the intermediate layer of the collar section and the intermediate layer of the body section to the outer layer and to the inner layer.

6. The firefighter's coat of claim 1 in which the connection means includes extension means which extend laterally from at least two of the layers which are attached together.

7. The firefighter's coat of claim 1 in which the connection means includes tabs which are attached to the layers which are attached together and which extend laterally from the layers.

8. The firefighter's coat of claim 1 in which the connection means includes an elongate tab which is attached to the intermediate layer of the body section and which extends laterally therefrom, and the connection means includes an elongate tab which is attached to the intermediate layer of the collar section and which extends laterally therefrom, and in which the tab of the intermediate layer of the body section is attached to the tab of the intermediate layer of the collar section.

9. The firefighter's coat of claim 1 in which the connection means includes a plurality of attachment elements, each of the layers of the collar section and each of the layers of the body section having an attachment element which is attached thereto and which extends laterally therefrom, the attachment elements of the collar layers being attached to the attachment elements of the respective body layers.

10. The firefighter's coat of claim 1 in which the connection means includes an elongate tab which extends laterally from the intermediate layer of the body section, and the connection means includes an elongate tab which extends laterally from the intermediate layer of the collar section, an attachment strip positioned between the tab of the body section and the tab of the collar section and attached thereto, the attachment strip extending laterally from the intermediate layer of the body section and from the intermediate layer of the collar section, and means attaching the attachment strip to at least one of the other layers.

11. The firefighter's coat of claim 1 in which the moisture barrier means includes an elongate tape member which is adhesively attached to the intermediate layer of the collar section and to the intermediate layer of the body section.

12. The firefighter's coat of claim 1 in which the moisture barrier means is an integral part of the intermediate moisture barrier layer of the collar section and an integral part of the intermediate moisture barrier layer of the body section, the intermediate moisture barrier layer of the collar section and the intermedite moisture barrier layer of the body section and moisture barrier means thus forming a continuous intermediate moisture barrier layer between the outer layer and the inner layer.

13. The firefighter's coat of claim 1 in which the intermediate moisture barrier layer of the collar section has a tab which extends laterally in given direction and the intermediate moisture barrier layer of the body section has a tab which extends laterally in a direction opposite to the given direction, a first sealing strip, the first sealing strip being adhesively attached to the intermediate moisture barrier layer of the collar section and also being attached to one of the tabs, a second sealing strip, the second sealing strip being adhesively attached to one of the tabs and also being attached to the intermediate moisture barrier layer of the body section.

14. The firefighter's coat of claim 1 in which the moisture barrier means is integral with the intermediate moisture barrier layer of the body section and with the intermediate moisture barrier layer of the collar section, and wherein the intermediate moisture barrier layer of the body section and the intermediate moisture barrier layer of the collar section and the moisture barrier means form a continuous moisture barrier layer which extends through the body section and through the collar section, and means connecting the continuous moisture barrier layer to at least one of the other layers to stabilize the moisture barrier layer and the collar section.

15. The firefighter's coat of claim 14 in which a tab is adhesively attached to the continuous moisture barrier layer and to one of the other layers to stabilize the moisture barrier layer and the collar section.

16. The firefighter's coat of claim 1 in which the collar section moisture barrier layer and the body section moisture barrier layer and the moisture barrier means are integral and form a single element intermediate barrier layer, a strip of attachment material between the collar section moisture barrier layer and the body section moisture barrier layer and attached thereto, the strip of attachment material having an extending portion extending from the intermediate barrier layer, and means attaching the extending portion of the strip of attachment material to one of the other layers.

17. The firefighter's coat of claim 1 in which a strip of attachment material is positioned between the collar section moisture barrier layer and the body section moisture barrier layer and attached thereto and extending therefrom, a sealing member adhesively attached to the strip of attachment material and to the collar section moisture barrier layer and sealing against flow of fluid between the collar section moisture barrier layer and the strip of attachment material, and a sealing member adhesively attached to the strip of attachment material and to the body section moisture barrier layer and sealing against flow of fluid between the strip of attachment material and the body section moisture barrier layer.

18. A firefighter's coat which is waterproof while also having a stabilized collar section, the firefighter's coat comprising a body section and a collar section, the body section including an outer layer and an intermediate moisture barrier layer and an inner layer, the collar section including an outer layer and an intermediate moisture barrier layer and an inner layer, the collar section having an attachment portion adjacent the body section, connection means attaching the intermediate moisture barrier layer of the body section and the intermediate moisture barrier layer of the collar section to at least one of the other layers adjacent the attachment portion of the collar section, and sealing means sealing the connection means, the intermediate moisture barrier layer of the collar section and intermediate moisture barrier layer of the body section thus preventing flow of moisture therethrough while being attached to at least one of the other layers to provide a stabilized collar section.

19. A firefighter's coat which is waterproof while also having a stabilized collar section, comprising a body section and a collar section, the body section including a plurality of layers, the collar section including a plurality of layers, one of the layers of the body section and one of the layers of the collar section comprising a moisture barrier layer, and moisture barrier connection means joining the moisture barrier layer of the collar section to the moisture barrier layer of the body section, and attachment means attaching the moisture barrier layer to one of the other layers.

20. The firefighter's coat of claim 19 in which the moisture barrier connection means comprises an integral portion of the moisture barrier layer of the body section and an integral portion of the moisture barrier layer of the collar section, wherein the moisture barrier layer of the body section and the moisture barrier layer of the collar section and the moisture barrier connection means form a continuous single element moisture barrier layer.

21. A firefighter's coat which is waterproof while also having a stabilized collar section, the firefighter's coat comprising a body section and a collar section, the body section including an outer layer and an inner layer, the collar section including an outer layer and an inner layer, the collar section having an attachment portion adjacent the body section, the coat also including a moisture barrier intermediate layer which is positioned between the outer layer and the inner layer, the intermediate layer including a collar portion and a body portion, connection means attaching the moisture barrier intermediate layer to at least one of the other layers adjacent the attachment portion of the collar section, and sealing means sealing the connection means, the intermediate moisture barrier layer preventing flow of moisture therethrough while being attached to at least one of the other layers to provide a stabilized collar section.

22. The method of producing a firefighter's coat which is waterproof while also having a stabilized collar section, comprising forming a body section which includes a plurality of layers and which includes a moisture barrier layer, forming a collar section which includes a plurality of layers and which includes a moisture barrier layer, joining the moisture barrier layer of the collar section to the moisture barrier layer of the body section to prevent flow of water therebetween, and connecting the moisture barrier layer of the body section and the moisture barrier layer of the collar section to at least one of the other layers to provide a stabilized collar section.

23. The method of claim 22 in which the moisture barrier layer of the collar section and the moisture barrier layer of the body section are integrally joined together and formed as a single element.

24. The method of claim 22 in which the layers of the body section and the layers of the collar section are formed by positioning the moisture barrier layer of the collar section and the moisture barrier layer of the body section between an outer layer and an inner layer.

25. The method of claim 22 which includes joining the moisture barrier layer of the collar section to the moisture barrier layer of the body section by adhesively attaching a strip of moisture barrier material to the moisture barrier layer of the collar section and to the moisture barrier layer of the body section.

26. The method of claim 22 which includes joining the moisture barrier layer of the collar section to the moisture barrier layer of the body section by forming a tab on the moisture barrier layer of the collar section and forming a tab in the moisture barrier layer of the body section, followed by attaching the tab of the moisture barrier layer of the collar section to the tab of the moisture barrier layer of the body section.

27. The method of claim 22 in which the moisture barrier layer of the collar section and the moisture barrier layer of the body section are connected to at least one of the other layers by means of a tab which is adhesively attached to at least one of the moisture layers and to at least one of the other layers.

* * * * *